US006889796B2

(12) United States Patent
Pocock et al.

(10) Patent No.: US 6,889,796 B2
(45) Date of Patent: May 10, 2005

(54) LOUDSPEAKER SUSPENSION

(75) Inventors: Nicholas Pocock, Hants (GB); Simon Yorick Pettman, Locks Heath (GB)

(73) Assignee: Goodmans Loudspeakers Limited, Hampshire (GB)

( * ) Notice: Subject to any disclaimer, the term of this patent is extended or adjusted under 35 U.S.C. 154(b) by 165 days.

(21) Appl. No.: 10/059,856

(22) Filed: Jan. 28, 2002

(65) Prior Publication Data

US 2002/0144859 A1 Oct. 10, 2002

(30) Foreign Application Priority Data

Jan. 29, 2001 (GB) ..... 0102281

(51) Int. Cl.[7] ..... G10K 13/00

(52) U.S. Cl. ..... 181/172; 181/171; 181/173; 181/174; 181/157

(58) Field of Search ..... 181/172, 157, 181/171, 173, 174

(56) References Cited

U.S. PATENT DOCUMENTS 3,997,023 A * 12/1976 White ..... 181/171
4,881,617 A * 11/1989 Faraone ..... 181/164
5,455,396 A * 10/1995 Willard et al. ..... 181/172

FOREIGN PATENT DOCUMENTS

| | | |
|---|---|---|
| GB | 369476 | 3/1932 |
| GB | 726780 | 3/1955 |
| GB | 1247434 | 9/1971 |
| GB | 2035008 | 6/1980 |
| GB | 2055528 | 3/1981 |
| GB | 2348336 | 9/2000 |

* cited by examiner

*Primary Examiner*—Shih-Yung Hsieh
(74) *Attorney, Agent, or Firm*—Hodgson Russ LLP

(57) ABSTRACT

An annular surround for a loudspeaker cone wherein a radial cross-section of the surround varies around the circumferential extent of the surround, so as to accommodate peripheral expansion or contraction of the surround by bending. Thus a trough shaped cross-section of the surround may vary sinusoidally with angle around the polar axis of the surround between a semicircular and semielliptical cross-section. The trough section may bland to an adjacent portion of the surround by a fillet which also varies sinusoidally in cross-section in phase with the variation of the trough.

11 Claims, 4 Drawing Sheets

LOUDSPEAKER SUSPENSION

BACKGROUND OF THE INVENTION

This invention relates to a loudspaker suspension and to a loudspeaker cone or other diaphragm comprising a suspension.

A loudspeaker typically comprises a relatively rigid cone driven by a voice coil at the apex of the cone, the cone being supported around its basal edge from a ring shaped fixed frame by a relatively flexible suspension. Ideally the cone responds identically at all frequencies within its operating range so that input audio signals are converted to sound waves without change in relative power or phase, and without generation of harmonics. Thereby distortion and coloration can be avoided.

This objective cannot be fully achieved in practice. In particular it can be impeded by the flexible surround failing to permit adequate axial movement of the edge of the cone at low frequencies, or by it having an axial stiffness which varies with axial displacement, or by the surround deforming asymmetrically (buckling) upon axial displacement.

SUMMARY OF THE INVENTION

The present invention, at least in its preferred embodiments, is directed to offering an improved suspension which is less subject to the foregoing disadvantages.

In one aspect the invention provides a suspension for a loudspeaker diaphragm having an elongate peripheral dimension, and wherein in operation, changes in that dimension caused by vibrations of the diaphragm are accommodated by bending of parts of the suspension.

Preferably a cross-section of the suspension containing tie elongate dimension has a sinuous or concertina-like, profile, said bending being such as to expand or contract the sinuous or concertina-like profile.

The said parts may be hinge-points at the peaks and troughs of tie profile.

In operation the axial movement of the diaphragm causes hoop stresses in the suspension. In a conventional suspension these stresses must be accommodated by the suspension stretching circumferentially (peripherally). The suspension material is stiff in tension, and thus the compliance of the suspension is reduced and the ability of the speaker to extend axially is compromised. In the present invention, advantage is taken of the fact that the material is much less stiff in bending to achieve an adequately-compliant suspension. In a preferred form, the suspension material is of corrugated or concertina-like form around the periphery of the surround so that it may expand and contract easily in the peripheral direction.

In a preferred form a radial cross-section of the suspension varies around a circumferential extent of the suspension.

In another aspect the invention provides an annular suspension for a loudspeaker diaphragm being an annular surround and wherein a radial cross-section of the surround varies around the circumferential extent of the suspension.

The radial cross-section may vary so that the surround has a circumferentially-extending undulating form.

Preferably the variation is periodic. For example the radial cross-section may vary sinusoidally with angle around a polar axis of the suspension.

The radial cross-section may include a trough-shaped portion.

The depth of the trough may vary around the circumferential extent of the suspension. The width of the trough may be substantially constant.

The greatest depth of the trough may be between 1.1 and 1.5 times, preferably 1.2 and 1.4 times, more preferably 1.2 and 1.3 times, the least depth of the trough.

The trough may be of generally U-shaped cross-section, and may vary between a semicircular and semielliptical cross-section.

In one embodiment, the trough merges with an adjacent part of the surround by a fillet or blending radius which varies around the circumferential extent of the suspension.

The adjacent part may be a radially inner flange of the suspension.

Preferably, the variation of the fillet or blending radius is in step with the variation of the radial cross-section of the suspension.

Thus the variation of the fillet or blending radius is periodic and has a constant phase relationship with the variation of the radial cross-section.

The fillet or blending radius may vary sinusoidally with angle around the polar axis of the suspension.

The cross-section of the fillet or the maximum of the blending radius may be in phase with the maximum depth of the trough.

The invention also includes a loudspeaker cone or other loudspeaker diaphragm having a suspension as set forth above.

The invention now will be described merely by way of example with reference to the accompanying drawings wherein:

DETAILED DESCRIPTION OF THE INVENTION

Figure 1:
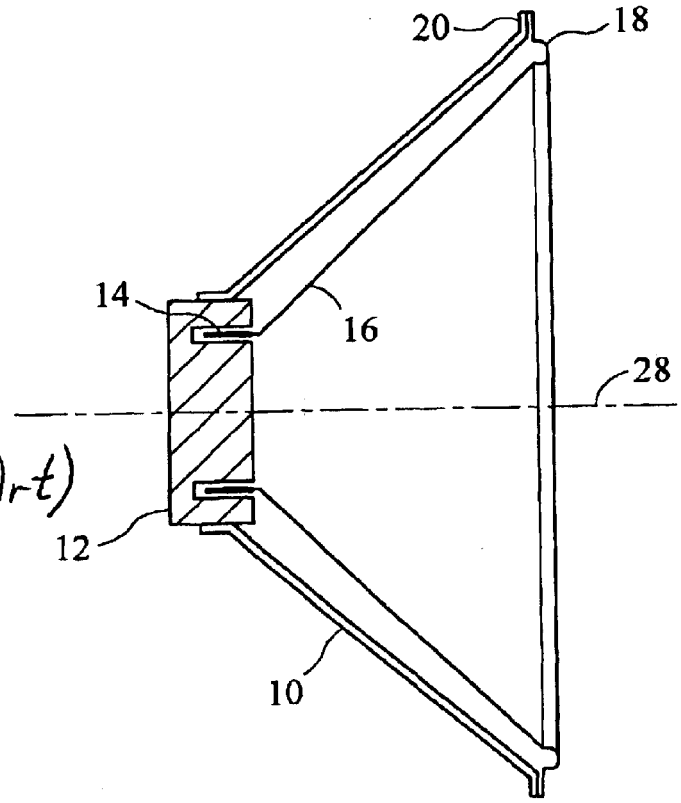
Fig. 1 (Prior Art)
FIG. 1 shows a section through a typical loudspeaker.

In FIG. 1 a typical loudspeaker comprises a frame or chassis 10 supporting a permanent magnetic circuit 12 having a gap wherein a voice coil 14 of a cone 16 is received. The basal edge of the cone terminates in a surround or suspension 18 the outer edge of which is fixed to a mounting ring 20 of the frame.

The cone 16, here circular in shape, is typically molded from a relatively stiff plastics material such as ADSTIFF (TM) polypropylene and is as stiff as a light as possible so as to respond faithfully to an electroacoustic driving signal applied to the voice coil.

Figure 2:
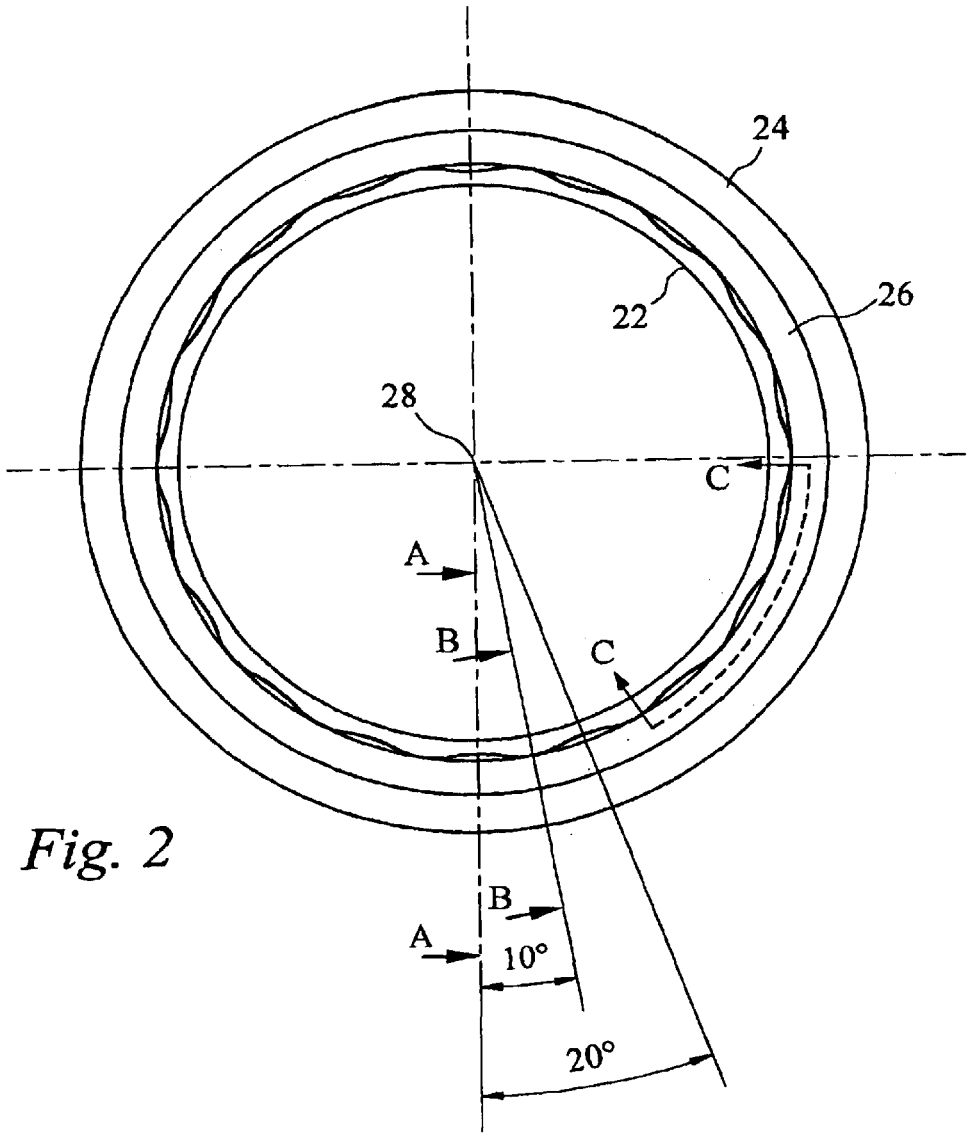
FIG. 2 is an axial front view of a loudspeaker cone incorporating a suspension surround of the invention.
Figure 4:
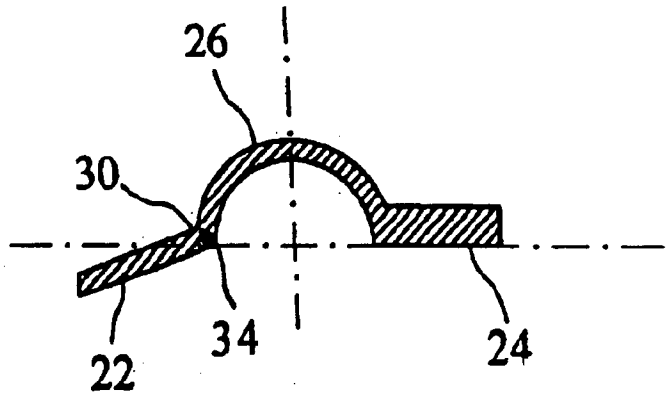
FIGS. 3 and 4 respectively are sections on lines A—A and B—B of FIG. 2.
Figure 3:
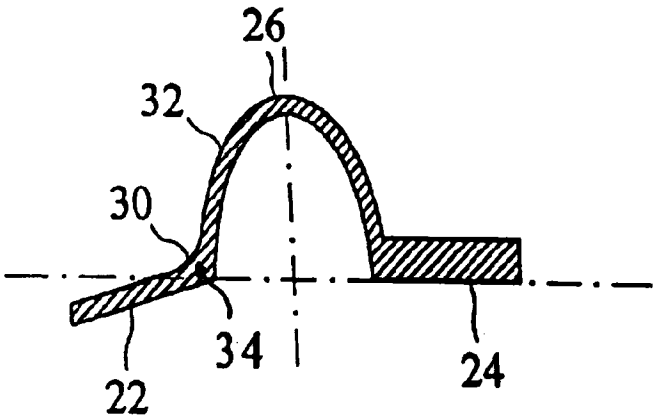

Referring to FIGS. 2, 3 and 4 the surround 18 of this invention is of a softer and more flexible material than the cone, for example a mixture of polypropylene eg. ADFLEX (TM) and an elastomer, eg. SARLINK (TM), compatible with the cone material so that it can be overmoulded, ultrasonically welded thermally bonded or glued to it, a radially inner flange 22 being provided for this purpose. A radially outer flange 24 enables the outer margin of the sound to be secured between the frame ring 20 and a baffle as known per se. The surround, when assembled to the cone 16 is suitable in this example for a speaker of nominal 150 mm (6 inches) diameter. The material of the surround is approximately 0.2 mm thick, and the radial width of the flexible parts of the surround (ie. excluding the relatively thick outer flange 24) is approximately 100 times the material thickness.

The surround 18 is generally trough-shaped in section radially of the cone, the trough section 26 varying around the circumference of the cone so as to be of an undulating form. Specifically, the depth of the trough varies whilst the width remains constant.

FIG. 3 shows one limit of the cross-sectional variation, and FIG. 4 shows the other limit. It can be seen that the depth of the trough 26 (roll height in FIGS. 3 and 4) at section A—A (FIG. 3) where it is semi-elliptical in shape is approximately 1.25 times the depth at section B—B (FIG. 4) where it is semicircular. The variation in depth is chosen according to the required peripheral stiffness; the greater the variation the lower the stiffness. The appropriate depth ratio is conveniently found empirically by modelling. A ratio of between 1.1 and 1.5, preferably 1.2 to 1.3 or 1.4 is suggested.

The variation between sections A—A and B—B is sinusoidal with angle around the polar axis 28 of the cone 16, with (in this embodiment) a period of 20 degrees ie. eighteen pitches around the circumference of the cone.

The trough 26 is blended to the flanges 22, 24 by blending radius or fillets. The blending radius between the trough and outer flange 24 is constant, but the radius 30 between the outer surface 32 of the trough 26 and the inner flange 22 varies periodically around the circumference of the surround in this example between 0.2 mm and 2.0 mm This results in a fillet 34 of periodically varying cross-section, as can be seen by comparing FIGS. 3 and 4. The variation of the radius 30 is sinusoidal with angle around the polar axis of the surround, and bears a constant phase-relationship to the variation of the depth of the trough, such that radius 30 and the cross-sectional area of the fillet 34 are at their respective maxima when the depth of the trough also is a maximum. This improves the impedance matching of the surround to the cone and stiffens the hinge between the surround and the cone, so as to shift the vibration mode associated with the hinge to a higher frequency.

Figure 5:
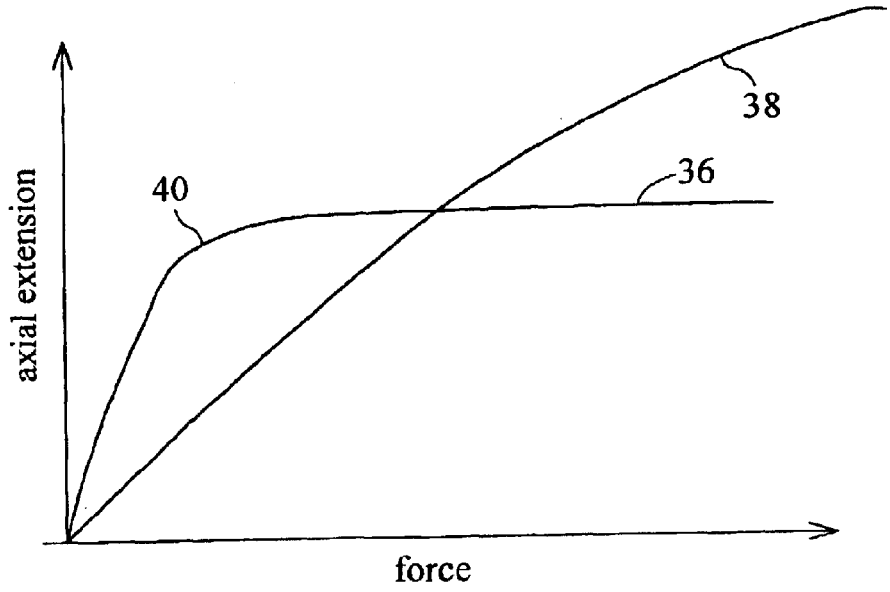
FIG. 5 is a graph comparing the characteristics of a surround of the invention with those of a prior art surround.

FIG. 5 compares the axial deflection-force characteristics of otherwise-similar cones provided with a conventional surround, and a surround according to the invention.

The conventional cone is initially relatively elastic, as shown by curve 36 but at a relatively low displacement it reaches the limit of its axial deflection and exhibits greatly increased stiffness, generally due to the surround buckling. This increases the higher harmonics of low frequency, distortion modes, particularly below the fundamental resonance of the cone.

In contrast, a surround according to the invention has a relatively constant stiffness (curve 38) over a significantly greater axial extension. This is because the periodic undulating variations in the cross-section of the surround provide reserves of material which can deform to accommodate greater axial movement than in the prior art cone.

This improved characteristic is believed by the applicant to be explained by the following, although the applicant does not wish to be limited by this explanation or other explanations offered in this specification.

To accommodate the axial movement of the rim of the cone 16, the material of the surround 18 has to expand and contract circumferentially. In a conventional surround there is little freedom for the material to do this, so as soon as any slack is taken up (point 40 in FIG. 5 ) circumferential expansion gives rise to tensile (hoop) stresses. Hence the surround exhibits greatly increased stiffness.

Figure 6:
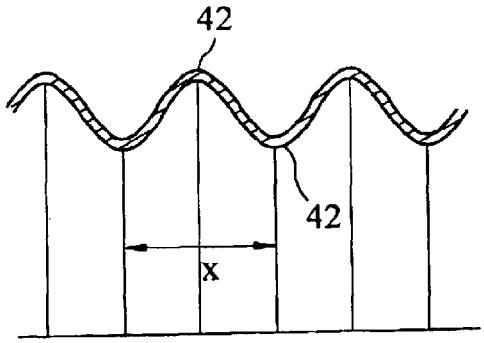
FIG. 6 is a section on line C—C of FIG. 2.

In the preferred embodiment of the present invention, if one considers a cylindrical section through the surround centred on the axis of the cone, as shown in FIG. 6, it can be seen that the section exhibits sinuous or concertina-like form. The elongate circumferential length of the section (x-wise in FIG. 6) can easily be expanded or contracted by bending of the material eg. about points 42, in the manner of a concertina bellows.

The stiffness of the structure thus is uniform over a much greater range of axial extension of the cone than a prior art surround, resulting in a displacement/force characteristic such as curve 38 in FIG. 5. Because the compliance of the surround comes from the hinge-points 42 will be appreciated that, whilst the sinusoidal form of the undulations is preferred, other undulating, serpentine or corrugated forms providing such hinge-points may also be found effective.

The fillet 34 assists in raising the frequency of the first resonant mode of the cone. Typically without the fillet 34 it would be at about 1.5 KHz. With the fillet it is moved to perhaps 2.5 KHz.

The periodically-varying form of the fillet is intended to equalise the axial extension available angularly around the cone. The surround will first pull tight at extreme axial extension where the trough 26 is relatively shallow (FIG. 4). Making the fillet 34 smaller where the trough is shallow then where it is deep reduces the variation in axial extension available around the perimeter of the cone, because a large fillet will constrain the adjacent edge portion of the trough more than a small one.

Additionally, it is believed that a periodically-varying fillet section improves the impedance matching of the cone to the surround There is an abrupt change in the impedance faced by wave propagating from the cone to the surround; the material properties change from a stiff poorly damped material to one which (due to the undulations) appears flexible and well-damped. Also there is a large change in profile, which in dynamic terms is equivalent to an added mass. The fillet radius is thought to provide a more gradual change in impedance as seen by the traveling wave, which reduces the proportion of the wave reflected at the junction. Thus standing waves (ie. resonances) are reduced. Because the greatest change in impedance is believed to be where the trough 26 is deepest, it is indicated to align the greatest fillet area with the deepest parts of the trough.

However, the relative dispositions of the trough undulations and the fillet cross-section variations are best considered from cone to cone with the assistance of finite element analysis.

Figure 7:
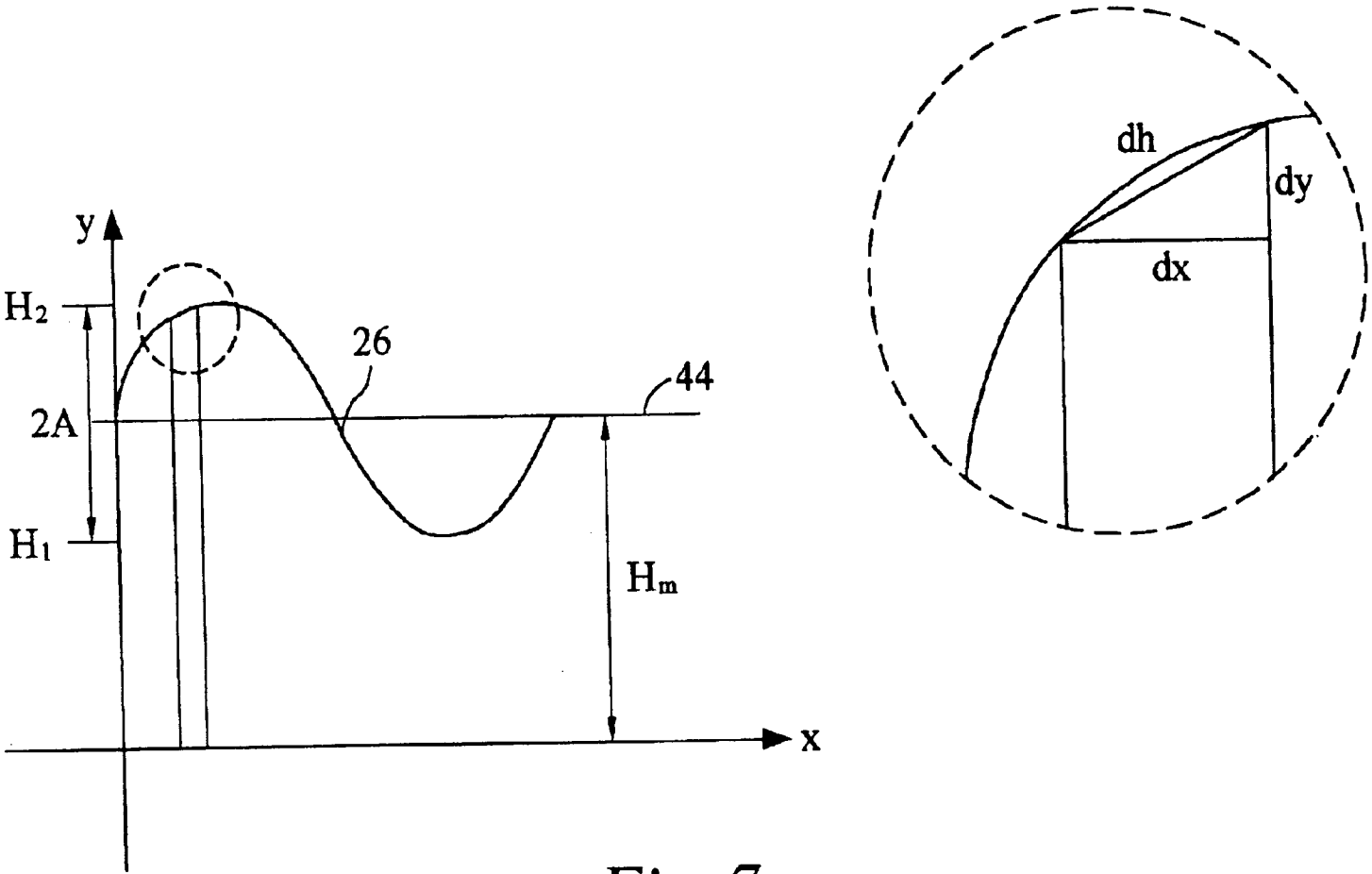
FIG. 7 is an analysis of the section of FIG. 6.

FIG. 7 illustrates a theoretical basis for calculating the periodic variation in the depth of the trough 26, when this variation is sinusoidal.

Considering an elemental portion of the trough 26, viewed as in FIG. 6, the variation in the depth of the trough about its median depth 44 is given by $$y = A \sin(\omega x)$$

where A is the amplitude of the variation from the median Thus $$dy/dx = A\omega\cos(\omega x)$$

$$dy = A\omega\cos(\omega x).dx$$

$$dh = (dx^2 + A^2\omega^2\cos^2(\omega x)dx^2)^{1/2}$$

The total circumferential length of one periodic variation is $$\sum_{x=0}^{2\pi} dh = \int (1 + A^2\omega^2\cos^2(\omega x))^{1/2} dx. \quad (1)$$

When during vibration the diameter of the surround increases from D to D+d, the additional circumferential length of material required is πd.

Taking an example of a surround for which D=129 mm with eighteen circumferential pitches as in FIG. 2, it can be assumed that the diameter will not expand by more than 0.5 mm, and consequently the extra circumferential length will be π/2 mm, or about 1.6 mm.

Substituting A=0.45 mm, ω=2πf=0.279, D=129 and n=18 into equation (1) gives $$\int_0^{n/f} (1 + A^2\omega^2\cos^2(\omega x))^{1/2} dx - \pi D = 1.593.$$

so for practical purposes a value of A=0.45 mm is appropriate.

In this case, the mean trough depth Hm is 4.05 mm, from which $H_1$=3.6 mm, $H_2$=4.5 mm $H_2/H_1$, the ratio of the maximum trough depth to the minimum trough depth, is 1.25.

Although described in the context of a circular cone and surround, the invention also is applicable to loudspeaker cones of other shapes eg. elliptical. It also is applicable to non-conical ie. substantially flat speaker diaphragms when a surround-type mounting is required.

For non-circular cones it will be appreciated that if the angular pitch of the trough undulations is kept constant, its linear (circumferential) pitch will vary. Conversely, keeping the linear pitch constant will result in a varying angular pitch. Finite element analysis will assist in finding the preferred arrangement in a particular case. It could be that neither constant angular pitch nor constant linear pitch is optimal; this could well be the case if the perimeter of the cone or other diaphragm is not circular or elliptic.

Each feature disclosed in this specification (which term includes the claims) and/or shown in the drawings may be incorporated in the invention independently of other disclosed and/or illustrated features.

Statements in this specification of the "objects of the invention" relate to preferred embodiments of the invention, but not necessarily to all embodiments of the invention falling within the claims.

The abstract filed herewith is repeated here as part of the specification.

An annular surround for a loudspeaker cone wherein a radial cross-section of the surround varies around the circumferential extent of the surround, so as to accommodate peripheral expansion or contraction of the surround by bending. Thus a trough shaped cross-section of the surround may vary sinusoidally with angle around the polar axis of the surround between a semicircular and semielliptical cross-section. The trough section may blend to an adjacent portion of the surround by a fillet which also varies sinusoidally in cross-section in phase with the variation of the trough.

What is claimed is:

1. A suspension for a loudspeaker diaphragm being an annular surround, wherein a radial cross-section of the surround varies around the circumferential extent of the suspension, wherein the radial cross-section of the suspension includes a trough-shaped portion, and wherein the depth of the trough varies around the circumferential extent of the suspension.

2. A suspension as claimed in claim 1 wherein the width of the trough is substantially consistent.

3. A suspension as claimed in claim 1 wherein the greatest depth of the trough is between 1.1 and 1.5 times, the least depth of the trough.

4. A suspension as claimed in claim 1 wherein the trough varies between a semicircular and semielliptical cross-section.

5. A suspension as claimed in claim 1 wherein the fillet or blending radius varies sinusoidally with angle around a polar axis of the suspension and wherein a maximum cross-section of the fillet or a maximum of the blending radius is in phase with a maximum depth of the trough.

6. A suspension for a loudspeaker diaphragm being an annular surround, wherein a radial cross-section of the surround varies around the circumferential extent of the suspension, wherein the radial cross-section of the suspension includes a trough-shaped portion, and wherein the trough merges with an adjacent part of the suspension by a fillet or blending radius which varies around the circumferential extent of the suspension.

7. A suspension as claimed in claim 6 wherein the adjacent part is a radially inner flange of the suspension.

8. A suspension as claimed in claim 6 wherein the variation of the fillet or blending radius is in step with the variation of the radial cross-section of the suspension.

9. A suspension as claimed in claim 8 wherein the variation of the fillet or blending radius is periodic and has a consistent phase relationship with the variation of the radial cross-section.

10. A suspension as claimed in claim 9 wherein the fillet or blending radius varies sinusoidally with angle around the polar axis of the suspension.

11. A suspension as claimed in claim 10 wherein the fillet or blending radius varies sinusoidally with angle around the polar axis of the suspension and wherein the maximum cross-section of the fillet or the maximum of the blending radius is in phase with the maximum depth of the trough.

* * * * *